US008425753B2

(12) United States Patent
Aksu et al.

(10) Patent No.: US 8,425,753 B2
(45) Date of Patent: Apr. 23, 2013

(54) ELECTROPLATING METHODS AND CHEMISTRIES FOR DEPOSITION OF COPPER-INDIUM-GALLIUM CONTAINING THIN FILMS

(75) Inventors: Serdar Aksu, San Jose, CA (US); Mustafa Pinarbasi, Morgan Hill, CA (US)

(73) Assignee: SoloPower, Inc., San Jose, CA (US)

( * ) Notice: Subject to any disclaimer, the term of this patent is extended or adjusted under 35 U.S.C. 154(b) by 463 days.

(21) Appl. No.: 12/642,702

(22) Filed: Dec. 18, 2009

(65) Prior Publication Data

US 2010/0140101 A1 Jun. 10, 2010

Related U.S. Application Data

(63) Continuation-in-part of application No. 12/123,372, filed on May 19, 2008, now Pat. No. 8,066,865, and a continuation-in-part of application No. 12/371,546, filed on Feb. 13, 2009, now Pat. No. 7,892, 413.

(60) Provisional application No. 61/150,721, filed on Feb. 6, 2009.

(51) Int. Cl.

| | |
|---|---|
| ***C25D 5/10*** | (2006.01) |
| ***C25D 5/50*** | (2006.01) |
| ***C25D 7/12*** | (2006.01) |
| ***C25D 3/56*** | (2006.01) |

(52) U.S. Cl.
USPC ..... 205/157; 205/176; 205/182; 205/224; 205/228; 205/239

(58) Field of Classification Search ..... 205/157
See application file for complete search history.

(56) References Cited

U.S. PATENT DOCUMENTS

| | | | |
|---|---|---|---|
| 2,582,377 | A | 1/1952 | Brown |
| 2,793,179 | A | 5/1957 | De La Breteque |

(Continued)

FOREIGN PATENT DOCUMENTS

| | | |
|---|---|---|
| EP | 0251302 | 1/1988 |
| EP | 1103637 | 5/2001 |

(Continued)

OTHER PUBLICATIONS

International Search Report issued Feb. 18, 2011 in corresponding PCT/US2010/60704.

(Continued)

*Primary Examiner* — Patrick Ryan
*Assistant Examiner* — William Leader
(74) *Attorney, Agent, or Firm* — Pillsbury Winthrop Shaw Pittman LLP

(57) ABSTRACT

The present invention provides a method and precursor structure to form a solar cell absorber layer. The method includes electrodepositing a first layer including a film stack including at least a first film comprising copper, a second film comprising indium and a third film comprising gallium, wherein the first layer includes a first amount of copper, electrodepositing a second layer onto the first layer, the second layer including at least one of a second copper-indium-gallium-ternary alloy film, a copper-indium binary alloy film, a copper-gallium binary alloy film and a copper-selenium binary alloy film, wherein the second layer includes a second amount of copper, which is higher than the first amount of copper, and electrodepositing a third layer onto the second layer, the third layer including selenium; and reacting the precursor stack to form an absorber layer on the base.

14 Claims, 1 Drawing Sheet

U.S. PATENT DOCUMENTS

| | | | |
|---|---|---|---|
| 2,873,232 | A | 2/1959 | Zimmerman |
| 3,032,890 | A | 5/1962 | Brick et al. |
| 3,061,528 | A | 10/1962 | Foley, Jr. |
| 3,475,292 | A | 10/1969 | Shousanian |
| 4,199,416 | A | 4/1980 | Middleton |
| 4,450,786 | A | 5/1984 | Doehler et al. |
| 4,452,675 | A | 6/1984 | Cipris et al. |
| 4,488,942 | A | 12/1984 | Martin et al. |
| 4,492,181 | A | 1/1985 | Ovshinsky et al. |
| 4,581,108 | A | 4/1986 | Kapur et al. |
| 4,723,507 | A | 2/1988 | Ovshinsky et al. |
| 4,798,660 | A | 1/1989 | Ermer et al. |
| 4,826,579 | A | 5/1989 | Westfall |
| 5,215,631 | A | 6/1993 | Westfall |
| 5,275,714 | A | 1/1994 | Bonnet et al. |
| 5,304,403 | A | 4/1994 | Schlesinger et al. |
| 5,378,639 | A | 1/1995 | Sasaki et al. |
| 5,489,372 | A | 2/1996 | Hirano |
| 5,501,786 | A | 3/1996 | Gremion |
| 5,554,211 | A | 9/1996 | Bokisa et al. |
| 5,571,749 | A | 11/1996 | Matsuda |
| 5,695,627 | A | 12/1997 | Nakazawa |
| 5,730,852 | A | 3/1998 | Bhattacharya |
| 5,804,054 | A | 9/1998 | Bhattacharya |
| 5,871,630 | A | 2/1999 | Bhattacharya et al. |
| 5,976,614 | A | 11/1999 | Bhattacharya |
| 6,048,442 | A | 4/2000 | Kushiya et al. |
| 6,602,440 | B2 | 8/2003 | Bishop et al. |
| 6,852,210 | B2 | 2/2005 | Obata |
| 7,297,868 | B2 | 11/2007 | Bhattacharya |
| 7,507,321 | B2 | 3/2009 | Aksu et al. |
| 2004/0063320 | A1 | 4/2004 | Hollars et al. |
| 2004/0161533 | A1 | 8/2004 | Sawayama et al. |
| 2004/0206390 | A1 | 10/2004 | Bhattacharya |
| 2005/0173255 | A1 | 8/2005 | Bokisa et al. |
| 2005/0215079 | A1 | 9/2005 | Taunier et al. |
| 2006/0151331 | A1 | 7/2006 | Taunier et al. |
| 2007/0093006 | A1 | 4/2007 | Basol |
| 2007/0111367 | A1 | 5/2007 | Basol et al. |
| 2007/0116893 | A1 | 5/2007 | Zwaap et al. |
| 2007/0272558 | A1 | 11/2007 | Aksu et al. |
| 2008/0057616 | A1 | 3/2008 | Robinson et al. |
| 2008/0169025 | A1 | 7/2008 | Basol et al. |
| 2009/0283411 | A1 | 11/2009 | Aksu et al. |
| 2009/0283414 | A1 | 11/2009 | Wang et al. |

FOREIGN PATENT DOCUMENTS

| | | |
|---|---|---|
| FR | 2849532 | 7/2004 |
| JP | 4-080371 | 3/1992 |
| JP | 6-204536 | 7/1994 |
| JP | 7-235504 | 9/1995 |
| JP | 08120479 | 5/1996 |
| JP | 11-135811 | 5/1999 |

OTHER PUBLICATIONS

International Search Report issued Feb. 18, 2011 in corresponding PCT/US2010/60712.

Ganchev et al., "Preparation of Cu(In,Ga)Se2 Layers by Selenization of Electrodeposited CU-IN-GA Precursors", Thin Solid Films, vol. 511-512, 2006, pp. 325-327.

Ganchev et al., "Investigation of the Electrodeposition Process in the Cu-In-Se System", Solar Energy and Mats and Solar Cels, vol. 31, 1993, pp. 163-170.

Herrero, et al., "Electrodeposition of Cu-In Alloys for Preparationg CuInS2 Thin Films", Solar Energy Materials, vol. 20, 1990, pp. 53-65.

Hodes, et al., "Electroplated CuInS2 and CuInSe2 Layers: Preparation and Physical and Photovoltaic Characterization", Thin Solid Films, vol. 128, 1985, pp. 93-106.

Ishizaki et al., "The Effect of Citric Acid and EDTA Addition on Cu-In Alloy Electrochemical Deposition", Mat. Transactions, JIM, vol. 40, 1999, pp. 867-870.

Jost et al., "Real time Investigations on the Formation of CuInSe2 Thin Film Solar Cell Absorbers from Electrodeposited Precursors", Solar Energy Mats and Solar Cells, vol. 91, 2007, pp. 636-644.

Kampman, et al., "A Cadmium-free CuInSe2 Superstrate Solar Cell Fabricated by Electrodeposition Using a ITO/In2Se3/CuInSe2/Au Structure", Progress in Photovoltaics, vol. 7, 1999, pp. 129-135.

Kumar, et al., "Rapid Thermal Annealing of Cu-In/Se Stacked Layers", Semiconductor Science and Tech,, vol. 6, 1991, pp. 940-941.

Lockhande et al. , "Preparation of CuInSe2 and CuInS2 Films by Reactive Annealing in H2Se or H2S", Solar Cells, vol. 21, 1987. pp. 215-224.

Prosini, et al., "Electrodeposition of Copper-Indium Alloy Under Diffusion-Limiting Current Control", Thin Solid Films, vol. 288, 1996, pp. 90-94.

Singh, et al., "Electrodeposited Semiconducting CuInSe2 Films: I. Preparation, Structural and Electrical Characterisation", J. Phys, D.: Applied Phys., vol. 19, 1986, pp. 1299-1309.

Andreoli, et al., "Electrochemical Approaches to $GaAs_{1-x}Sb_x$Thin Films ", *J. Electroanalyt. Chem*., vol. 385, 1995, p. 265-268.

Backris, et al., "Electrodepotiion of Gallium on Liquid and Solid Gallium Electrodes in Alkaline Solutions", *J. Electrochem. Soc*., vol. 109, 1962, p. 48.

Bhattacharya, R.N., et al., "$CuIn_{1-x}Ga_xSe_2$–based Photovoltaic Cells from Electrodeposited Precursor Films", *Solar Energy Mats & Solar Cells*, vol. 76, 2003, pp. 331-337.

Binsma, J.J., et al., "Preparation of Thin $CuInS_2$ Films via a Two Stage Process", *Thin Solid Films*, 97, 1982, pp. 237-243.

Bouabid et al., "CuIn1-xGaxSe2 Thin Films Prepared by one Step Electrodeposition", J. Phys IV France, vol. 123 (no month, 2005), pp. 53-57.

Calixto, M.E., et al., "$CuInSe_2$ Thin Films Formed by Selenization of Cu-In Precursors", *J. of Mats. Sci*., 33, 1998, pp. 339-345.

Fernandez, et al., "Electroeposited and Selenized ($CuInSe_2$) (CIS) Thin Films for Photovoltaic Applications", *Solar Energy Materials and Solar Cells*,52, 1998, pp. 423-431.

Friedfeld, R., et al., "Electrodeposition of $CuIn_xGa_1$–$xSe_2$ Thin Films", *Solar Energy Mats. & Solar Cells*, 58, 1999, pp. 375-385.

Fritz, H.P., et al., "A New Electrochemical Method for Selenization of Stacked CuIn Layers and Preparation of $CuInSe_2$ by Thermal Annealing", *Thin Solid Films*, 247, 1994, pp. 129-133.

Grindle, S.P., et al., "Preparation and Properties of $CuInS_2$ Thin Films Produced by Exposing rf-Sputtered Cu-In Films to an $H_2S$ Atmosphere", *Appl. Phys. Lett*, 35(1) Jul. 1, 1979, pp. 24-26.

Guillen, C., et al., "New Approaches to Obtain $CuIn_{1-x}Ga_xSe_2$ Thin Films by Combining Electrodeposited and Evaporated Precursors", *Thin Solid Films*, 323, 1998, pp. 93-98.

Guillen, C.,et al., "$CuInSe_2$ Thin Films Obtained by a Novel Electrodeposition and Sputtering Combined Method," *Vacuum*, 58, 2000, pp. 594-601.

Gupta, A., et al., "$CuInS_2$ Films Prepared by Sulfurization of Electroless Deposited Cu-In Alloy", *Solar Energy Mats*., 18, 1988, pp. 1-8.

Kampmann, A., et al., "Electrodeposition of CIGS on Metal Substrates", *Mat. Res. Soc. Symp. Proc*., 763, 2003, pp. B8.5.1-B8.5.6.

Kapur, V.K., et al., "Low Cost Thin Film Chalcopyrite Solar Cells", *IEEE*, 1985, p. 1429-1432.

Kapur, V.K., et al., "Low Cost Methods for the Production of Semiconductor Films for $CuInSe_2$/CdS Solar Cells", *Solar Cells*, 21, 1987, pp. 65-72.

Kim, et al., "Preparation of $CuInSe_2$ Thin Films Using Electrodeposited In/Cu Metallic Layer", *First WCPEC*, Dec. 5-9, 1994, Hawaii, *IEEE*, pp. 202-205.

Kumar, et al., "Properties of $CuInSe_2$ Films Prepared by the Rapid Thermal Annealing Technique", *Thin Solid Films*, 223, 1993, pp. 109-113.

Lokhande, C., et al., "Preparation of $CuInSe_2$ and $CuInS_2$ Films by Reactive Annealing in $H_2$ $Se_2$ or $H_2$ S", *Solar Cells*,, 21, 1987, pp. 215-224.

Sundararajan, et al., "The Electrodeposition of Gallium from a Chloride Bath", *J. Less. Comm. Metals*., vol. 11, 1966, p. 360-364.

Taunier, S., et al., "$Cu(In,Ga)(S,Se)_2$ Solar Cells and Modules by Electrodeposition", *Thin Solid Films*, 480-481, 2005, pp. 526-531.

Wijesundera, R.P., et al., "Preparation of $CuInS_2$ Thin Films by Electrodeposition and Sulphurisation for Applications in Solar Cells", *Solar Energy Mats. & Solar Cells*, 81, 2004, pp. 147-154.

Zank, J., et al., "Electrochemical Codeposition of Indium and Gallium for Chalcopyrite Solar Cells", *Thin Solid Films*, 286, 1996, pp. 259-263.
Xia, et al., "Influence of Na Citrate Concentration on Cu(In,Ga)Se2 Thin Films by Electrodeposition", Regong Jingti Xuebau, (Aug. 2005), vol. 34, No. 4, pp. 704-708.
Fernandez, A.M., "Optimisation of the Electochemical Bath for Growing Device-Quality $CuInSe_2$ Thin Films", *Advanced materials for Optics and Electronics*, vol. 8 1998, pp. 1-8.
Fernandez, A.M., "Electrodeposited and Selenized ($CuInSe_2$) (CIS) Thin Films for Photovoltaic Applications", *Solar Energy Materials and Solar Cells*, vol. 52, 1998, pp. 423-431.
Fernandez, A.M., et al. "Electrodeposition of $CuInSe_2$ Thin Films for Photovoltaic Application", *WRECT 1996*, pp. 396-399.
Hermann, et al., "Low-cost Deposition of $CuInSe_2$ (CIS) Films for CdS/CIS Solar Cells", *Solar Energy Materials and Solar Cells*, vol. 52, 1998, pp. 355-360.
Herrero, et al., "Electrochemical Synthesis of Photoactive $In_2$ $Se_3$ Thin Films", *Solar Energy Materials*, vol. 16, 1987 pp. 477-485.
Igasaki, et al., "The Preparation of Highly Oriented InSe Films by Electrodeposition", *J. of Crystal Growth*, vol. 158, 1996, pp. 268-275.
Kampmann, et al., "Large Area Electrodeposition of $Cu(In,Ga)Se_2$", *Thin Solid Films*, vol. 361-362, 2000, pp. 309-313.
Massaccesi, et al., "Electrodeposition of Indium Selenide $In_2$ $Se_3$", *J. of Electroanalytical Chem*., vol. 412, 1996, pp. 95-101.
Thouin, et al., "formation of Copper Indium Diselenide by Electrodeposition". *J. of Electroanalytical Chem*., vol. 374, 1994, pp. 81-88.
Yukawa, et al., "Electrodeposition of $CuInS_2$ from Aqueous Solution Part I. Electrodeposition of Cu-S Film", *Thin Solid Film*, vol. 280, 1996, pp. 160-162.
Donglin, et al., Co-Electrodeposition and Characterization of Cu(In,Ga)Se2 Thin Films, J. Mat. Sci. , (No month, 2006), vol. 41, pp. 1875-1878.
Pottier and Maurin, "Preparation of Polycrystalline Thin Films of CuInSe2 by Electrodeposition," J. App. Electrochemistry, vol. 19, 1989, pp. 361-367.
European Search Report issued May 19, 2011 in corresponding EP 07872342.
Kumar, SR, "Preparation and Characterisation of Copper Indium Selenide Thin Film Solar Cells", *Department of Materials and Metallurgical Engineering, National Institute of Fundry and Forge Technology*; Ranchi—834003; (no month, 2002), pp. 205-211.
Search Report issued May 11, 2012 in corresponding EP 10739244.
Ganchev, et al., "Preparation of Cu(In,Ga)Se2 Layers by Selenization of Electrodeposited Cu-In-Ga Precursors", Thin Solid Films, vol. 511-512, Jul. 26, 2006, pp. 325-327.
Aksu, et al., "Electrodeposition of In-Se and Ga-Se Thin Films for Preparation of CIGS Solar Cells", Electrochemical and Solid State Letters, vol. 12, No. 5, Jan. 1, 2009, pp. D33-D35.

ELECTROPLATING METHODS AND CHEMISTRIES FOR DEPOSITION OF COPPER-INDIUM-GALLIUM CONTAINING THIN FILMS

CROSS REFERENCES TO RELATED APPLICATIONS

This application is a Continuation-in-Part of U.S. patent application Ser. No. 12/123,372, filed May 19, 2008, entitled "ELECTROPLATING METHODS AND CHEMISTRIES FOR DEPOSITION OF GROUP IIIB-GROUP VIA THIN FILMS" now U.S. Pat. No. 8,066,865, and this application is a Continuation in Part of U.S. patent application Ser. No. 12/371,546 filed Feb. 13, 2009 entitled "ELECTROPLATING METHODS AND CHEMISTRIES FOR DEPOSITION OF COPPER-INDIUM-GALLIUM CONTAINING THIN FILMS" now U.S. Pat. No. 7,892,413, which claims priority to U.S. Provisional Application No. 61/150,721, filed Feb. 6, 2009, entitled "ELECTROPLATING METHODS AND CHEMISTRIES FOR DEPOSITION OF COPPER-INDIUM-GALLIUM CONTAINING THIN FILMS", all of which are expressly incorporated herein by reference.

BACKGROUND

1. Field of the Inventions

The present invention relates to manufacturing solar cell absorbers and, more particularly, manufacturing solar cell absorbers using electrodeposition processes.

2. Description of the Related Art

Solar cells are photovoltaic devices that convert sunlight directly into electrical power. The most common solar cell material is silicon, which is in the form of single or polycrystalline wafers. However, the cost of electricity generated using silicon-based solar cells is higher than the cost of electricity generated by the more traditional methods. Therefore, since early 1970's there has been an effort to reduce cost of solar cells for terrestrial use. One way of reducing the cost of solar cells is to develop low-cost thin film growth techniques that can deposit solar-cell-quality absorber materials on large area substrates and to fabricate these devices using high-throughput, low-cost methods.

Group IBIIIAVIA compound semiconductors comprising some of the Group IB (copper (Cu), silver (Ag), gold (Au)), Group IIIA (boron (B), aluminum (Al), gallium (Ga), indium (In), thallium (Tl)) and Group VIA (oxygen (O), sulfur (S), selenium (Se), tellurium (Te), polonium (Po)) materials or elements of the periodic table are excellent absorber materials for thin film solar cell structures. Especially, compounds of Cu, In, Ga, Se and S which are generally referred to as CIGS(S), or $Cu(In,Ga)(S,Se)_2$ or $CuIn_{1-x}Ga_x(S_ySe_{1-y})_k$, where $0 \leqq x \leqq 1$, $0 \leqq y \leqq 1$ and k is approximately 2, have already been employed in solar cell structures that yielded conversion efficiencies approaching 20%. Absorbers containing Group IIIA element Al and/or Group VIA element Te also showed promise. Therefore, in summary, compounds containing: i) Cu from Group IB, ii) at least one of In, Ga, and Al from Group IIIA, and iii) at least one of S, Se, and Te from Group VIA, are of great interest for solar cell applications.

The structure of a conventional Group IBIIIAVIA compound photovoltaic cell such as a $Cu(In,Ga,Al)(S,Se,Te)_2$ thin film solar cell is shown in FIG. 1. The device 10 is fabricated on a base 20 including a substrate 11 and a conductive layer 13. The substrate can be a sheet of glass, a sheet of metal, an insulating foil or web, or a conductive foil or web. The absorber film 12, which includes a material in the family of $Cu(In,Ga,Al)(S,Se,Te)_2$, is grown over the conductive layer 13, which is previously deposited on the substrate 11 and which acts as the electrical contact to the device. Various conductive layers comprising molybdenum (Mo), tantalum (Ta), tungsten (W), titanium (Ti), and stainless steel etc. have been used in the solar cell structure of FIG. 1. If the substrate itself is a properly selected conductive material, it is possible not to use a conductive layer 13, since the substrate 11 may then be used as the ohmic contact to the device. After the absorber film 12 is grown, a transparent layer 14 such as a cadmium sulfide (CdS), zinc oxide (ZnO) or CdS/ZnO stack is formed on the absorber film. Radiation 15 enters the device through the transparent layer 14. Metallic grids (not shown) may also be deposited over the transparent layer 14 to reduce the effective series resistance of the device. A variety of materials, deposited by a variety of methods, can be used to provide the various layers of the device shown in FIG. 1. It should be noted that although the chemical formula for a CIGS(S) layer is often written as $Cu(In,Ga)(S,Se)_2$, a more accurate formula for the compound is $Cu(In,Ga)(S,Se)_k$, where k is typically close to 2 but may not be exactly 2. For simplicity, the value of k will be used as 2. It should be further noted that the notation "Cu(X,Y)" in the chemical formula means all chemical compositions of X and Y from (X=0% and Y=100%) to (X=100% and Y=0%). For example, Cu(In,Ga) means all compositions from CuIn to CuGa. Similarly, $Cu(In,Ga)(S,Se)_2$ means the whole family of compounds with Ga/(Ga+In) molar ratio varying from 0 to 1, and Se/(Se+S) molar ratio varying from 0 to 1.

The first technique that yielded high-quality $Cu(In,Ga)Se_2$ films for solar cell fabrication was co-evaporation of Cu, In, Ga and Se onto a heated substrate in a vacuum chamber. Another technique for growing $Cu(In,Ga)(S,Se)_2$ type compound thin films for solar cell applications is a two-stage process where at least two components of the $Cu(In,Ga)(S,Se)_2$ material are first deposited onto a substrate, and then reacted with S and/or Se in a high temperature annealing process. For example, for $CuInSe_2$ growth, thin layers of Cu and In may be first deposited on a substrate and then this stacked precursor layer may be reacted with Se at elevated temperature. If the reaction atmosphere also contains sulfur, then a $CuIn(S,Se)_2$ layer can be grown. Addition of Ga in the precursor layer, for example use of a Cu/In/Ga stacked film precursor, allows the growth of a $Cu(In,Ga)(S,Se)_2$ absorber.

Sputtering and evaporation techniques have been used in prior art approaches to deposit the layers containing the Group IB and Group IIIA components of the precursor stacks. In the case of $CuInSe_2$ growth, for example, Cu and In layers were sequentially sputter-deposited on a substrate and then the stacked film was heated in the presence of a gas containing Se at elevated temperature for times typically longer than about 30 minutes, as described in U.S. Pat. No. 4,798,660. More recently U.S. Pat. No. 6,048,442 disclosed a method comprising sputter-depositing a stacked precursor film comprising a Cu—Ga alloy layer and an In layer to form a Cu—Ga/In stack on a metallic back electrode layer and then reacting this precursor stack film with one of Se and S to form the absorber layer. Such techniques may yield good quality absorber layers and efficient solar cells, however, they suffer from the high cost of capital equipment, and relatively slow rate of production.

One prior art method described in U.S. Pat. No. 4,581,108 utilizes a low cost electrodeposition approach for metallic precursor preparation for a two-stage processing technique. In this method a Cu layer is first electrodeposited on a substrate. This is then followed by electrodeposition of an In layer forming a Cu/In stack during the first stage of the process. In the second stage of the process, the electrodeposited Cu/In stack is heated in a reactive atmosphere containing Se forming a $CuInSe_2$ compound layer.

In another approach Cu—In or Cu—In—Ga alloys have been electroplated to form metallic precursor layers and then these precursor layers have been reacted with a Group VIA material to form CIGS type semiconductor layers. Some researchers electrodeposited all the components of the Group IBIIIAVIA compound layer. For example, for CIGS film growth electrolytes comprising Cu, In, Ga and Se were used. We will now review some of the work in this field.

Bonnet et al. (U.S. Pat. No. 5,275,714) electroplated Cu—In alloy layers out of acidic electrolytes that contained a suspension of fine Se particles. As described by Bonnet et al., this method yielded an electrodeposited Cu—In alloy layer which contained dispersed selenium particles since during electrodeposition of Cu and In, the Se particles near the surface of the cathode got physically trapped in the growing layer. Lokhande and Hodes (Solar Cells, vol.21, 1987, p. 215) electroplated Cu—In alloy precursor layers for solar cell applications. Hodes et al. (Thin Solid Films, vol.128, 1985, p.93) electrodeposited Cu—In alloy films to react them with sulfur to form copper indium sulfide compound layers. They also experimented with an electrolyte containing Cu, In and S to form a Cu—In—S layer. Herrero and Ortega (Solar Energy Materials, vol. 20, 1990, p. 53) produced copper indium sulfide layers through $H_2S$-sulfidation of electroplated Cu—In films. Kumar et al (Semiconductor Science and Technology, vol.6, 1991, p. 940, and also Solar Energy Materials and Solar Cells, vol.) formed a Cu—In/Se precursor stack by evaporating Se on top of an electroplated Cu—In film and then further processed the stack by rapid thermal annealing. Prosini et al (Thin Solid Films, vol.288, 1996, p. 90, and also in Thin Solid Films, vol.298, 1997, p. 191) electroplated Cu—In alloys out of electrolytes with a pH value of about 3.35-3.5. Ishizaki et al (Materials Transactions, JIM, vol.40, 1999, p. 867) electroplated Cu—In alloy films and studied the effect of citric acid in the solution. Ganchev et al. (Thin Solid Films, vol.511-512, 2006, p. 325, and also in Thin Solid Films, vol.516, 2008, p. 5948) electrodeposited Cu—In—Ga alloy precursor layers out of electrolytes with pH values of around 5 and converted them into CIGS compound films by selenizing in a quartz tube.

Some researchers co-electrodeposited Cu, In and Se to form CIS or $CuInSe_2$ ternary compound layers. Others attempted to form CIGS or $Cu(In,Ga)Se_2$ quaternary compound layers by co-electroplating Cu, In, Ga and Se. Gallium addition in the quaternary layers was very challenging in the latter attempts. Singh et al (J. Phys.D: Appl. Phys., vol.19, 1986, p. 1299) electrodeposited Cu—In—Se and determined that a low pH value of 1 was best for compositional control. Pottier and Maurin (J. Applied Electrochemistry, vol.19, 1989, p. 361 electroplated Cu—In—Se ternary out of electrolytes with pH values between 1.5 and 4.5. Ganchev and Kochev (Solar Energy Matl. and Solar Cells, vol.31, 1993, p. 163) carried out Cu—In—Se plating at a maximum pH value of 4.6. Kampman et al (Progress in Photovoltaics, vol. 7, 1999, p. 1999) described a CIS plating method. Other CIS and CIGS electrodeposition efforts include work by Bhattacharya et al (U.S. Pat. Nos. 5,730,852, 5,804,054, 5,871,630, 5,976,614, and U.S. Pat. No. 7,297,868), Jost et al (Solar Energy Matl. and Solar Cells, vol.91, 2007, p. 636) and Kampmann et al (Thin Solid Films, vol.361-362, 2000, p. 309).

The above mentioned electrodeposition solutions employed for Cu—In, Cu—In—Ga, Cu—In—S, Cu—In—Se and Cu—In—Ga—Se film depositions do not yield stable and repeatable electrodeposition process and high quality films that can be used in electronic device applications such as solar cell applications. Therefore, there is a need to develop efficient electrodeposition solutions and methods to deposit smooth and defect-free Group IB-Group IIIA alloy or mixture films in a repeatable manner with controlled composition.

SUMMARY OF THE INVENTION

The present invention provides a method and precursor structure to form a solar cell absorber layer.

In one aspect is described forming a precursor stack, comprising: electrodepositing a first layer including a film stack including at least a first film comprising copper, a second film comprising indium and a third film comprising gallium, wherein the first layer includes a first amount of copper, electrodepositing a second layer onto the first layer, the second layer including at least one of a second copper-indium-gallium-ternary alloy film, a copper-indium binary alloy film, a copper-gallium binary alloy film and a copper-selenium binary alloy film, wherein the second layer includes a second amount of copper, which is higher than the first amount of copper, and electro depositing a third layer onto the second layer, the third layer including selenium; and reacting the precursor stack to form an absorber layer on the base.

BRIEF DESCRIPTION OF THE DRAWING

These and other aspects and features of the present invention will become apparent to those of ordinary skill in the art upon review of the following description of specific embodiments of the invention in conjunction with the accompanying figures, wherein.

DETAILED DESCRIPTION OF THE PREFERRED EMBODIMENTS

The present invention provides various methods to form $Cu(In, Ga)(Se, S)_2$ absorber layers (CIGS) from electrodeposited precursors of the present invention. A precursor of the present invention may be formed as a stack having three layers. A first layer, which is copper poor, may be deposited over a base and a second layer, which is copper rich, deposited onto the first layer. A third layer including selenium is deposited onto the second layer before reacting the precursor to form the CIGS absorber layer. The first layer may include a Group IB-Group IIIA alloy or mixture of stacked films where the Group IB material is preferably Cu and the Group IIIA material is at least one of In and Ga. Such films may include (Cu—In), (Cu—Ga) and (Cu—In—Ga) alloy films or mixture such films. Alternatively, the first layer may include a mixture of stacked single element films, i.e., Cu, In, Ga films, or a mixture of such single element films and (Cu—In), (Cu—Ga) and (Cu—In—Ga) alloy films. The second layer also includes Group IB-Group IIIA alloy or mixture films. Preferably, the second layer may include at least one of a copper-indium-gallium-ternary alloy film, a copper-indium binary alloy film, a copper-gallium binary alloy film and a copper-selenium binary alloy film.

The embodiments, as describe herein, provide methods using electrodeposition solutions or electrolytes to co-electrodeposit uniform, smooth and compositionally repeatable "Group IB-Group IIIA" alloy or mixture films. Of course, the stoichiometry or composition of such films, e.g. Group IB/Group IIIA atomic ratio, may be controlled or varied into desired compositions by varying the appropriate plating conditions to vary the amount of Group IB and Group IIIA or VIA materials in the first layer and the second layer. Through the use of embodiments described herein it is possible to form micron or sub-micron thick alloy or mixture films on conductive contact layer surfaces for the formation of solar cell absorbers.

Figure 1:
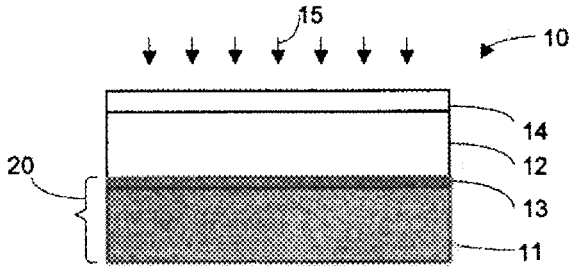
FIG. 1 is a schematic view of a prior art solar cell structure.
Figure 2A:
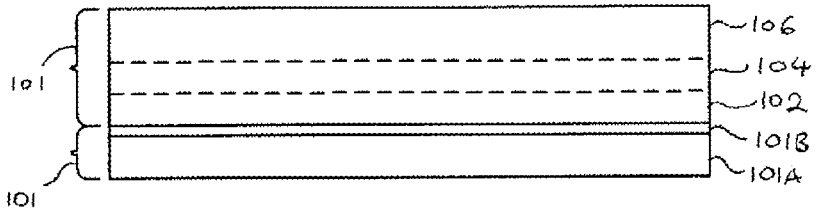
FIG. 2A is a schematic view of a precursor stack electrodeposited on a base.
Figure 2B:
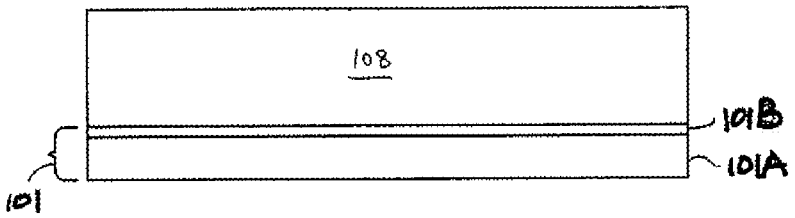
FIG. 2B is a schematic view of a CIGS absorber layer formed when the precursor stack shown in FIG. 2A is reacted.

FIG. 2A shows a precursor stack 100 or layer formed on a base 101 according to the principles of the present invention. In this embodiment, the precursor stack 100 may be made of a multilayer structure including a first layer 102, a second layer 104 and a third layer 106. The precursor stack 100 is preferably formed using an electrodeposition process. During the electrodeposition process, initially, the first layer 102 may be electrodeposited over the base 102 which may include a substrate 101A and a contact layer 101B formed over the substrate. The second layer 104 is electrodeposited on the first layer 102 and the third layer 106 may be electrodeposited on the second layer. Principles of the electrodeposition process are well known and will not be repeated here for the sake of clarity. In the next step, the precursor stack 100 is reacted in a reactor to transform it into an absorber layer 108 i.e., CIGS absorber layer, shown in FIG. 23. The contact layer 101B may be made of a molybdenum (Mo) layer deposited over the substrate 101A or a multiple layers or films of metals stacked on a Mo layer; for example, molybdenum and ruthenium multilayer (Mo/Ru), or molybdenum, ruthenium and copper multilayer (Mo/Ru/Cu). To form a contact layer having multi layers, for example, Ru layer may be electrodeposited on the Mo layer, and similarly the Cu layer may be electrodeposited on the Ru layer to form the contact layer. The substrate 101A may be a flexible substrate, for example a stainless steel foil, or an aluminum foil, or a polymer. The substrate may also be a rigid and transparent substrate such as glass.

As will be described more fully below, the first layer 102 and the second layer 104 of the precursor stack 100 comprise Group IB and Group IIIA materials, i.e., Cu, In and Ga. In one embodiment the second layer 104 may also include a Group VIA material, such as Se. Accordingly, the first layer 104 may be configured as a stack including a Cu-film, an In-film and a Ga-film, which will be shown with Cu/In/Ga insignia hereinbelow. This and similar insignia will be used throughout the application to depict various stack configurations, where the first material (element or alloy) symbol is the first film, the second material symbol is the second film deposited on the first film and so on. For example, in the Cu/In/Ga stack: the Cu-film, as being the first film of the stack, may be electrodeposited over the contact layer or another stack; the In-film (the second film) is electrodeposited onto the Cu-film; and the Ga-film (the third film) is deposited onto the In-film. In the first layer 102, the order of such films 102 may be changed, and the first layer 102 may be formed as a Ga/Cu/In stack or In/Cu/Ga stack. Furthermore, the first layer 102 may be formed as a stack of four films, such as Cu/Ga/Cu/In or Cu/In/Cu/Ga. In another embodiment, the first layer 102 may be formed as a (Cu—In—Ga) ternary alloy film or as a stack including (Cu—In) binary alloy film and (Cu—Ga) binary alloy film. Such alloy binary or ternary alloy films may have any desired compositions. The first layer 102 may be formed by any possible combinations of the above given stacks of films, binary films and ternary alloy films. Regardless of what combination is used to form it, the first layer 102 includes 35%-49% of the total molar amount of Cu of the precursor stack 100. The rest of the copper, which may be about 51%-65% of the total molar amount of Cu in the precursor layer 100, may be included in the second layer 104. The Cu/(In+Ga) molar ratio for the first layer 102 may be in the range of 0.25 to 0.49.

Referring back to FIG. 2A, the second layer 104 of the precursor stack 100 may include at least one of a (Cu—In—Ga) ternary alloy film, a (Cu—In) binary alloy film and (Cu—Ga) binary alloy film or the mixtures of such films. Alternatively, the second layer 104 may include a (Cu—Se) binary alloy film. The second layer 104 may have a Cu/(In+Ga) molar ratio in the range of 0.51 to 4. In the second layer 104, the amount of copper may be graded vertically between a bottom surface of the second layer 104 (adjacent the top of the first layer 102) and the top surface of the second layer 104 (adjacent the bottom of the third layer 106). When graded, for example, the top portion of the second layer 104 may be made more copper rich than the bottom portion of it. Of course, the bottom portion of the second layer 104 may also be made copper rich with the same approach. The third layer 106 may include Se.

In one example, the first layer 102 may be a Cu/Ga/Cu/In stack, and the second layer 104 may be one of (Cu—In—Ga) ternary alloy film, (Cu—In) binary alloy film, (Cu—Ga) binary alloy film and (Cu—Se) binary alloy film, and the third layer 106 is a selenium layer. In another example, the first layer 102 may be replaced with one of Ga/Cu/In stack, In/Cu/Ga stack and Cu/In/Cu/Ga stack. As mentioned above, in this embodiment, each layer of the precursor stack 100 is electrodeposited from selected electrodeposition solutions or electrolytes. During the process, single element electrolytes, such as a Cu electrolyte, In electrolyte, Ga electrolyte or Se electrolyte, are used to deposit films of these elements. Such electrodeposition solutions includes Cu, In and Ga material sources and complexing agents for each elements. Copper in the electrolyte may be provided by a Cu source such as dissolved Cu metal or a Cu salt such as Cu-sulfate, Cu-chloride, Cu-acetate, Cu-nitrate, and the like. Indium and gallium sources comprise dissolved In and Ga metals, and dissolved In and Ga salts. The In salts may include In-chloride, In-sulfate, In-sulfamate, In-acetate, In-carbonate, In-nitrate, In-phosphate, In-oxide, In-perchlorate, and In-hydroxide, and the like, and wherein the Ga salts may include Ga-chloride, Ga-sulfate, Ga-sulfamate, Ga-acetate, Ga-carbonate, Ga-nitrate, Ga-perchlorate, Ga-phosphate, Ga-oxide, and Ga-hydroxide, and the like. Ethylenediaminetetraacetic acid, tartrate and citrate were selected as suitable complexing agents for Cu, In and Ga, respectively. The pH regime used in the single element electrodeposition solutions is neutral to alkaline pH regime (pH>7). This pH regime was chosen to realize the full potential of the complexation. Deprotonated forms of complexing agents become more predominant with increasing pH, allowing formation of more stable soluble metal-complex species.

For (Cu—In—Ga) ternary alloy film and (Cu—In) or (Cu—Ga) binary alloys films, the preferred electrodeposition solutions comprise a Cu source material, at least one Group IIIA (Ga and In) material, from the above given source materials, and a blend of at least two complexing agents that have the ability to complex with Cu and both or one of the Group IIIA metals to keep them from precipitating in the non-acidic electrolyte which has a pH value of larger than or equal to 7. As is commonly known in the art of electrodeposition, complexing agents are soluble species that combine with metal ions in solution to form soluble complexes or complex ions. It should be noted that the acidic solutions of the prior art techniques may not have used such complexing agents since Group IIIA species typically remain in solution at acidic pH values. In this embodiment, exemplary electrodeposition solutions for (Cu—Ga) binary films preferably comprise citric acid or a citrate, and exemplary electrodeposition solutions for (Cu—In) binary films preferably comprise tartaric acid or a tartrate. Exemplary electrodeposition solutions for (Cu—In—Ga) ternary films preferably comprise a blend of complexing agents including both citrate and tartrate. Using such specific blend of complexing agents at the neutral and high pH ranges improves the plating efficiencies of these Group IB-IIIA materials. Citrates in the blend efficiently complex with the Ga species, tartrates in the blend efficiently complex with the In species. Both tartrates and citrates, on the other hand, complex well with Cu species. In order to enhance the complexation of Cu, EDTA could also be included in the (Cu—In—Ga) electrodeposition solution, because EDTA may form more stable complexes with Cu. Therefore, in electrodeposition solutions comprising Cu and both In and Ga species, it is beneficial to include a blend of complexing agents comprising tartrates (or tartaric acid), citrates (or citric acid) and possibly EDTA (in either its acidic form or in the form of alkali and alkali earth metal salts of EDTA) to obtain high plating efficiencies and good compositional control, i.e. Cu/In, Cu/Ga, Cu/(In+Ga) molar ratios. It should be noted that other complexing agents may additionally be included in the solution formulation.

As mentioned above the electrodeposition solutions or electrolytes used in the embodiments herein preferably have pH values of 7 or higher. A more preferred pH range is above 9. These basic pH values are suitable for large scale manufacturing and provide good complexation for all of the Cu, In and Ga species in the electrolyte and bring their plating potentials close to each other for better repeatability and control of the plated alloy film compositions. It is for this reason that the Ga content of the (Cu—In—Ga) films of the embodiments may be controlled at will in a range from 0% to 100%. This is unlike prior art electrodeposition solutions and methods which generally had difficulty to include appreciable amount of Ga in the electroplated layers due to excessive hydrogen generation due to high negative plating potential of Ga out of acidic electrolytes. It should be noted that the pH values of the prior art plating solutions for the above mentioned group of materials is acidic and less than 7. The embodiments described herein use a neutral (7) to basic (greater than 7) range for the pH values of the electrodeposition solutions and employ at least one complexing agent to effectively complex one of Cu, In and Ga at this pH range. The benefits of such high pH ranges and use of specific complexing agents for the electrodeposition of Ga containing metallic layers (see for example, U.S. patent application Ser. No. 11/535,927, filed Sep. 27, 2006, entitled "Efficient Gallium Thin Film Electroplating Methods and Chemistries"), (In, Ga)—Se containing layers (see for example, U.S. patent application Ser. No. 12/123,372, filed May 19, 2008, entitled "Electroplating Methods and Chemistries for Deposition of Group IIIA-Group VIA thin films") and Se layers (see for example, U.S. patent application Ser. No. 12/121,687, filed May 15, 2008, entitled "Selenium Electroplating Chemistries and Methods"), each of which are expressly incorporated herein by reference in their entirety.

Although various complexing agents such as tartaric acid, citric acid, acetic acid, malonic acid, malic acid, succinic acid, ethylenediamine (EN), ethylenediaminetetra acetic acid (EDTA), nitrilotriacetic acid (NTA), and hydroxyethylethylenediaminetriacetic acid (HEDTA), etc. may be employed in the electrodepositon solutions for ternary alloy films and higher order material alloy films, the preferred complexing agents are tartaric acid or a tartrate, such as potassium sodium tartrate ($KNaC_4H_4O_6$) and citric acid or a citrate such as sodium citrate, lithium citrate, ammonium citrate, potassium citrate, and an organically modified citrate.

For Cu—Se, Se material source may comprise at least one of dissolved elemental Se, acids of Se and dissolved Se compounds, wherein the Se compounds include oxides, chlorides, sulfates, sulfides, nitrates, perchlorides and phosphates of Se. Some of the preferred sources include but are not limited to selenous acid (also known as selenious acid) ($H_2SeO_3$), selenium dioxide ($SeO_2$), selenic acid ($H_2SeO_4$), selenium sulfides ($Se_4S_4$, $SeS_2$, $Se_2S_6$) sodium selenite ($Na_2SeO_3$), telluric acid ($H_6TeO_6$), tellurium dioxide ($TeO_2$), selenium sulfides ($Se_4S_4$, $SeS_2$, $Se_2S_6$), thiourea ($CSN_2H_4$), and sodium thiosulfate ($Na_2S_2O_3$).

The preferred complexing agent for the electrolytes used for electroplating Cu—Se binary alloy containing films comprises EDTA, citrates and tartrates. Using such complexing agents, it is possible to prepare plating solutions at both acidic and alkaline regime. An exemplary Cu—Se electrodeposition solution, which operates at low pH regime is provided in SP-103 (CIP of SP-101) and incorporated herein by reference.

In another embodiment the present invention provides a method to deposit Se containing layers under precursor stacks comprising films of Group IB, Group IIIA and Group VIA materials. As is well known, Ga and In cannot be directly plated on a selenium-containing layer without dissolving a large portion of Se during the electrodeposition. Se dissolves due to its reduction to $H_2Se$, $HSe^-$ or $Se^{2-}$ at the large negative cathodic potentials needed for the deposition of In and Ga. Such undesirable dissolution of Se from the Se-containing layer also occurs during Cu deposition over a Se-containing layer when the plating potential in this process falls below the reduction potential of Se to $H_2Se$, $HSe^-$ or $Se^{2-}$. Se dissolution problem from the Se-containing layer becomes more dramatic if there is a high resistance in the Se-containing layer for passing the desired electrical current during the electrodeposition of next layer. Se dissolution could be minimized or completely eliminated by plating a Cu-rich Cu—Se alloy layer of the present invention and then this layer is covered with a Cu cap layer deposited preferably from an acidic bath. Once a stacking of (Cu—Se)/Cu is formed in this way, other layers can be advantageously electrodeposited on Cu without dissolving the Se in the (Cu—Se) layer. Since molar ratio of Cu in such copper rich Cu—Se layer is more than 50%. The copper cap film, in the thickness range of 100 to 3000 Angstrom is deposited on the (Cu—Se) layer from a low pH (acidic) Cu electrodeposition solution to prevent low reduction potentials in which Se is prone to dissolve in the form of $H_2Se$ or $HSe^-$. After depositing the copper cap layer, films of Cu, Ga, and In, or their above described binary or ternary alloy films are electrodeposited on the (Cu—Se)/Cu stack. Absorber layers manufactured from such precursors including Se under other metallic films may improve overall solar cell efficiency. The following film stacks show various examples of precursor stacks including such (Cu—Se)/Cu layering structures, but not limited to: Cu/In/(Cu—Se)/Cu/Ga/Se; Cu/Ga/(Cu—Se)/Cu/In/Cu/In/(Cu—Se)/Cu/In/Se; Cu/In/(Cu—Se)/Cu/Ga/Cu/In/(Cu—Se)/Cu/In/Se; Cu/Ga/(Cu—Se)/Cu/Ga/Cu/(Cu—In)/(Cu—Se)/Cu/In/(Cu—Se)/Cu/Ga/Se; (Cu—In—Ga)/(Cu—Se)/Cu/Ga/Se; (Cu—Ga)/(Cu—Se)/Cu/In/Se; (Cu—In—Ga)/(Cu—Se)/Cu/Ga/Se; (Cu—Ga)/(Cu—Se)/Cu/In/Se and Cu/In/(Cu—Se)/Cu/Ga/Cu/(Cu—Ga—In)/(Cu—Se)/Cu/In/(Cu—Se)/Cu/Ga/Se.

Although the present invention is described with respect to certain preferred embodiments, modifications thereto will be apparent to those skilled in the art.

We claim:

1. A method of forming a solar cell absorber on a base, comprising:

forming a precursor stack, comprising:

electrodepositing a first layer including a film stack including at least a first film comprising copper, a second film comprising indium and a third film comprising gallium, wherein the first layer includes a first amount of copper, electrodepositing a second layer onto the first layer, the second layer including a copper-selenium binary alloy film, wherein the second layer includes a second amount of copper, which is higher than the first amount of copper, and electrodepositing a third layer onto the second layer, the third layer including selenium; and reacting the precursor stack to form an absorber layer on the base.

2. The method of claim 1, wherein the first amount of copper includes about 35-49% of the total molar copper amount in the precursor stack, and the second amount of copper includes about 51-65% of the total molar copper amount in the precursor stack.

3. The method of claim 2, wherein the step of electrodepositing the first layer electrodeposits at least the film stack, and the film stack includes a stack order comprising one of copper/indium/copper/gallium, copper/gallium/copper/indium, and indium/copper/gallium.

4. The method of claim 3, wherein the step of electrodepositing the first layer electrodeposits at least the film stack and at least one of the first film and the third film comprises copper-gallium binary alloy.

5. The method of claim 2, wherein the step of electrodepositing the first layer electrodeposits at least the film stack, and wherein the film stack further includes a fourth copper film.

6. The method of claim 5, wherein the film stack includes a stack order comprising one of copper/gallium/copper/indium and copper/indium/copper/gallium.

7. The method of claim 1, wherein the step of electrodepositing the first layer electrodeposits at least the film stack and at least one of the first film and the second film comprises copper-indium binary alloy.

8. The method of claim 1, wherein the step of electrodepositing the first layer electrodeposits at least the film stack and at least one of the first film and the third film comprises copper-gallium binary alloy.

9. The method of claim 1, wherein copper in the second layer is graded so that the amount of copper adjacent the first layer is less than the amount of copper at the top of the second layer.

10. The method of claim 9, wherein the step of electrodepositing the second layer comprises electrodepositing a lower copper selenide portion on the first layer and an upper copper selenide portion on the lower copper selenide portion.

11. The method of claim 10, wherein the upper copper selenide portion includes more copper than the lower copper selenide portion.

12. The method of claim 1, wherein the step of electrodepositing the second layer comprises electrodepositing a lower copper selenide portion on the first layer and an upper copper selenide portion on the lower copper selenide portion.

13. The method of claim 12, wherein the upper copper selenide portion includes more copper than the lower copper selenide portion.

14. The method of claim 1, wherein the step of electrodepositing the second layer comprises electrodepositing a copper selenide layer on the first layer and depositing a copper cap on the copper selenide layer.

* * * * *